US009705292B2

(12) United States Patent
Gozawa et al.

(10) Patent No.: US 9,705,292 B2
(45) Date of Patent: Jul. 11, 2017

(54) SPARK PLUG AND METHOD FOR PRODUCING THE SAME

(71) Applicant: NGK SPARK PLUG CO., LTD., Nagoya-shi, Aichi (JP)

(72) Inventors: Tatsuya Gozawa, Komaki (JP); Daisuke Sumoyama, Nagoya (JP); Tsutomu Shibata, Owariasahi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/245,583

(22) Filed: Aug. 24, 2016

(65) Prior Publication Data

US 2017/0063048 A1 Mar. 2, 2017

(30) Foreign Application Priority Data

Sep. 1, 2015 (JP) ..... 2015-172043

(51) Int. Cl.

| | |
|---|---|
| ***H01T 13/20*** | (2006.01) |
| ***H01T 13/32*** | (2006.01) |
| ***H01T 21/02*** | (2006.01) |
| ***H01T 13/39*** | (2006.01) |

(52) U.S. Cl.

CPC ..... *H01T 13/32* (2013.01); *H01T 13/39* (2013.01); *H01T 21/02* (2013.01)

(58) Field of Classification Search

CPC ..... H01T 13/32; H01T 21/02

See application file for complete search history.

(56) References Cited

U.S. PATENT DOCUMENTS

| | | | | |
|---|---|---|---|---|
| 4,670,684 | A | 6/1987 | Kagawa et al. | 313/141 |
| 5,465,022 | A * | 11/1995 | Katoh | H01T 21/02 313/142 |
| 2001/0013746 | A1* | 8/2001 | Kanao | H01T 13/39 313/144 |
| 2004/0100178 | A1* | 5/2004 | Kanao | H01T 21/02 313/141 |

(Continued)

FOREIGN PATENT DOCUMENTS

| | | | |
|---|---|---|---|
| FR | 2860655 | 4/2005 | H01T 13/39 |
| JP | 58-198886 | 11/1983 | H01T 13/20 |
| WO | WO 2010/058835 A1 | 5/2010 | H01T 13/20 |

OTHER PUBLICATIONS

Extended European Search Report issued in corresponding European Patent Application No. 16186881.5, dated Jan. 31, 2017.

*Primary Examiner* — Donald Raleigh

(74) *Attorney, Agent, or Firm* — Kusner & Jaffe

(57) ABSTRACT

A spark plug comprising a center electrode, a ground electrode disposed on the center electrode across a gap, and a tip joined to an opposed surface of the ground electrode that is opposed to the center electrode, the tip has a discharge layer and a relieving layer, the relieving layer is formed from a Pt—Ni alloy and joined to the opposed surface via a diffusion layer, the discharge layer is formed from a Pt—Rh alloy and joined via a clad diffusion layer to a side of the relieving layer opposite to a side of the relieving layer at which the ground electrode is joined, and $0.81 \leq A/B \leq 1.21$ is satisfied when an average cross-sectional area of the discharge layer is A $mm^2$ and an average cross-sectional area of the relieving layer is B $mm^2$, and a method for producing the spark plug.

5 Claims, 6 Drawing Sheets

(56) References Cited

U.S. PATENT DOCUMENTS

| | | | | |
|---|---|---|---|---|
| 2008/0074025 | A1 | 3/2008 | Hori | 313/141 |
| 2011/0198981 | A1* | 8/2011 | Kishimoto | H01T 13/39<br>313/141 |
| 2014/0184054 | A1* | 7/2014 | Nomura | H01T 13/20<br>313/141 |

* cited by examiner

SPARK PLUG AND METHOD FOR PRODUCING THE SAME

RELATED APPLICATIONS

This application claims the benefit of Japanese Patent Application No. 2015-172043, filed Sep. 1, 2015.

FIELD OF THE INVENTION

The present invention relates to a spark plug including a tip provided on a ground electrode, and a method for producing the spark plug.

BACKGROUND OF THE INVENTION

In an internal combustion engine such as an automobile engine, a Ni alloy or the like is generally used as a material forming a center electrode and a ground electrode. The Ni alloy is slightly inferior to a noble metal alloy containing a noble metal such as Pt or Ir as a principal component. However, the Ni alloy is suitably used as a material forming a ground electrode and a center electrode since Ni is cheaper than a noble metal.

Meanwhile, when spark discharge is caused between a front end portion of a ground electrode and a front end portion of a center electrode that are formed from a Ni alloy or the like, the respective opposed front end portions of the ground electrode and the center electrode are likely to cause spark wear. Thus, a method may be adopted in which a tip made of a noble metal is provided at each of the opposed front end portions of the ground electrode and the center electrode such that spark discharge is caused at the tip, thereby improving the wear resistance of the ground electrode and the center electrode.

Examples of a material forming the tip include Ir, an Ir alloy, and a Pt alloy (e.g., Japanese Patent Application Laid-Open (kokai) No. S58-198886). A method for joining the tip to each of the center electrode and the ground electrode is generally resistance welding. However, the joining strength may be insufficient.

For example, International Publication No. 2010/058835 discloses a spark plug for an internal combustion engine, "comprising: . . . a plate-like relieving layer tip joined to a front end portion of the ground electrode by means of resistance welding so as to be embedded therein; and a noble metal tip having one end surface that is joined by means of resistance welding to both a portion of the relieving layer tip at the center electrode side and a portion of the ground electrode at an outer peripheral side of a portion of the relieving layer tip at the center electrode side, the noble metal tip having another end surface forming a gap with a front end portion of the center electrode, wherein the noble metal tip is formed from a platinum alloy containing platinum as a principal component, the relieving layer tip is formed from a platinum alloy having a linear expansion coefficient between those of the platinum alloy forming the noble metal tip and a metal material forming the ground electrode, a portion of the relieving layer tip that is joined to the noble metal tip has an area smaller than an area of the one end surface of the noble metal tip, and a melt portion formed by melting at least the noble metal tip and the ground electrode by laser welding is provided on an entire outer periphery of a boundary portion between the ground electrode and the noble metal tip" (claim 1 of International Publication No. 2010/058835).

Meanwhile, in recent years, regarding an internal combustion engine such as an automobile engine, for achieving high output and improvement of fuel economy of the internal combustion engine, there is an increasing tendency to adopt an engine that directly injects fuel to the surrounding of a spark plug provided within a combustion chamber, or operate the internal combustion engine under a combustion condition in a high oxygen atmosphere such as lean burn. Under such a condition, a tip easily wears due to oxidation. Thus, a tip formed from an alloy containing Pt or Rh which has more excellent oxidation resistance than an Ir alloy or the like which has excellent spark wear resistance, is suitably used.

However, it has been found that, as shown in FIG. 7(*a*), such a tip formed from an alloy containing Pt and Rh bulges at a center portion thereof to deform into a convex shape under a specific condition in which a severe thermal cycle is repeated, whereby a spark discharge gap reduces to decrease ignitability or the tip peels off an electrode.

The above phenomenon more easily occurs as thermal stress generated in the tip and the electrode is greater. For example, in the case where the tip is joined to the electrode by means of laser welding, thermal stress can be relieved at a melt portion formed by the laser welding, so that the above phenomenon does not occur. Thus, it is conceivable to perform laser welding instead of or in addition to resistance welding, thereby relieving thermal stress to prevent occurrence of the above phenomenon. However, when the tip is joined to the electrode by means of laser welding, the performance as an electrode may diminish, conversely. For example, when a tip having a low height and a large width is joined to an electrode by means of laser welding, a melt portion is exposed in a discharge surface of the tip that contributes to spark discharge, so that the tip easily wears at the melt portion. As described above, under a specific condition such as the case of joining a tip having a low height and a large width to an electrode, the above problem cannot be solved by joining the tip by means of laser welding. Thus, a solution by other means is desired.

An advantage of the present invention is a spark plug that is able to suppress deformation and peeling of a tip, joined by a method different from laser welding, which occur under a specific condition in which a severe thermal cycle is repeated, and a method for producing the spark plug.

SUMMARY OF THE INVENTION (1) In accordance with a first aspect of the present invention, there is provided a spark plug including:

a center electrode;

a ground electrode disposed opposite to the center electrode with a gap therebetween; and a tip joined to an opposed surface of the ground electrode that is opposed to the center electrode, wherein the tip has a discharge layer and a relieving layer, the relieving layer is formed from a Pt—Ni alloy and joined to the opposed surface via a diffusion layer, the diffusion layer has a gradient composition in which a Pt content increases and/or a Ni content decreases from the ground electrode side toward the relieving layer side, the discharge layer is formed from a Pt—Rh alloy and joined via a clad diffusion layer to a side of the relieving layer opposite to a side of the relieving layer at which the ground electrode is joined, the clad diffusion layer has a gradient composition in Which a Pt content increases and/or a Ni content decreases from the relieving layer side toward the discharge layer side, and $0.81 \leq A/B \leq 1.21$ is satisfied when an average cross-sectional area of a plurality of cross-sections of the discharge layer obtained when the discharge layer is cut along planes parallel to the opposed surface is A $mm^2$ and an average cross-sectional area of a plurality of cross-sections of the relieving layer obtained when the relieving layer is cut along planes parallel to the opposed surface is B $mm^2$.

As preferable modes of the above (1), the following modes can be exemplified.

(2) In accordance with a second aspect of the present invention, there is provided a spark plug as described above, wherein, C>D is satisfied when a thickness of the clad diffusion layer is C μm and a thickness of the diffusion layer is D μm.

(3) In accordance with a third aspect of the present invention, there is provided a spark plug as described above, wherein the discharge layer has a total content of Pt and Rh of not less than 90 mass %.

(4) In accordance with a fourth aspect of the present invention, there is provided a method for producing a spark plug according to any one of above (1) to (3), the method including:

joining the relieving layer and the opposed surface to each other by means of solid phase diffusion joining after the discharge layer and the relieving layer are joined to each other by means of solid phase diffusion joining to form the tip.

The spark plug according to the present invention includes a tip that has a discharge layer formed from a Pt—Rh alloy and a relieving layer formed from a Pt—Ni alloy, and the ratio A/B between an average cross-sectional area A of a plurality of cross-sections of the discharge layer obtained when the discharge layer is cut along planes parallel to the opposed surface and an average cross-sectional area B of a plurality of cross-sections of the relieving layer obtained when the relieving layer is cut along planes parallel to the opposed surface satisfies $0.81 \leq A/B \leq 1.21$. Thus, deformation and peeling of the tip can be suppressed.

In the method for producing the spark plug according to the present invention, the relieving layer and the opposed surface are joined to each other by means of solid phase diffusion joining after the discharge layer and the relieving layer are joined to each other by means of solid phase diffusion joining to form the tip. Thus, the clad diffusion layer and the diffusion layer can be formed such that the thickness C of the clad diffusion layer is larger than the thickness D of the diffusion layer. Since the clad diffusion layer is disposed in the interior of the combustion chamber and exposed in a severe environment as compared to the diffusion layer, when crack occurs in the clad diffusion layer, there is a higher possibility that the crack develops so that the tip peels off, than when crack occurs in the diffusion layer. According to the method for producing the spark plug according to the present invention, since the clad diffusion layer and the diffusion layer can be easily formed such that the thickness C of the clad diffusion layer is larger than the thickness D of the diffusion layer, occurrence of crack in the clad diffusion layer, which is exposed in a severe environment, can be suppressed, and development of crack and peeling of the tip can be suppressed.

DETAILED DESCRIPTION OF THE PREFERRED EMBODIMENTS

Figure 1:
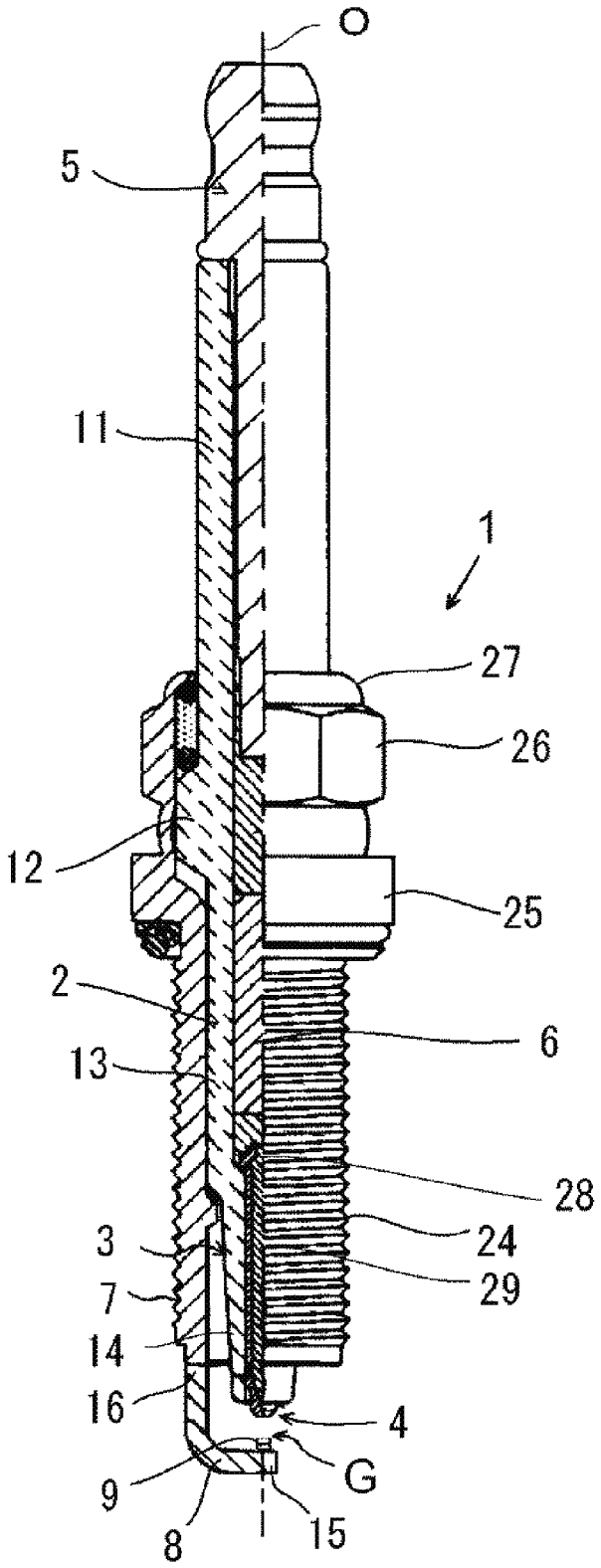
FIG. 1 is a partially sectional explanatory view of a spark plug that is an embodiment of a spark plug according to the present invention.

FIG. 1 shows a spark plug 1 that is an embodiment of a spark plug according to the present invention. FIG. 1 is a partially sectional explanatory view of the spark plug 1 that is the embodiment of the spark plug according to the present invention. A description will be given with: the downward direction on the sheet, that is, a side at which a later-described ground electrode is disposed, as a frontward direction along an axial line O; and the upward direction on the sheet as a rearward direction along the axial line O in FIG. 1.

As shown in FIG. 1, the spark plug 1 includes: a substantially cylindrical insulator 3 having an axial hole 2 extending in the direction of the axial line O; a substantially rod-shaped center electrode 4 disposed within the axial hole 2 and at the front side; a metal terminal 5 disposed within the axial hole 2 and at the rear side; a connection portion 6 disposed within the axial hole 2 and between the center electrode 4 and the metal terminal 5; a substantially cylindrical metallic shell 7 holding the insulator 3; a ground electrode 8 having one end portion joined to the front end of the metallic shell 7 and another end portion opposed to the center electrode 4 across a gap; and a tip 9 provided on the ground electrode 8.

The insulator 3 has the axial hole 2 extending in the direction of the axial line O, and has a substantially cylindrical shape. The insulator 3 includes a rear trunk portion 11, a large-diameter portion 12, a front trunk portion 13, and a leg portion 14. The rear trunk portion 11 houses the metal terminal 5 and insulates the metal terminal 5 and the metallic shell 7 from each other. The large-diameter portion 12 is disposed at the front side with respect to the rear trunk portion 11 and projects radially outward. The front trunk portion 13 is disposed at the front side of the large-diameter portion 12, has a smaller outer diameter than the large-diameter portion 12, and houses the connection portion 6. The leg portion 14 is disposed at the front side of the front trunk portion 13, has a smaller outer diameter and a smaller inner diameter than the front trunk portion 13, and houses the center electrode 4. The insulator 3 is fixed to the metallic shell 7 in a state where an end portion thereof in the frontward direction projects from the front end surface of the metallic shell 7. The insulator 3 is desirably formed from a material having desired mechanical strength, thermal strength, and electrical insulation property. An example of such a material is a ceramic sintered body that contains alumina as a main material.

The connection portion 6 is disposed within the axial hole 2 and between the center electrode 4 and the metal terminal 5, fixes the center electrode 4 and the metal terminal 5 within the axial hole 2, and electrically connects the center electrode 4 and the metal terminal 5 to each other.

The metallic shell 7 has a substantially cylindrical shape, and is formed such that the metallic shell 7 holds the insulator 3 when the insulator 3 is inserted therein. The metallic shell 7 has a screw portion 24 formed on the outer peripheral surface thereof in the frontward direction. The screw portion 24 is used for mounting the spark plug 1 to a cylinder head of an internal combustion engine that is not shown. The metallic shell 7 has a flange-shaped gas seal portion 25 at the rear side of the screw portion 24, a tool engagement portion 26, at the rear side of the gas seal portion 25, for engaging a tool such as a spanner or a wrench, and a crimping portion 27 at the rear side of the tool engagement portion 26. The front side of the inner peripheral surface of the screw portion 24 is located so as to have a space with respect to the leg portion 14. The metallic shell 7 can be formed from a conductive steel material such as low-carbon steel.

The metal terminal 5 is a terminal for applying a voltage for causing spark discharge between the center electrode 4 and the ground electrode 8, from the outside to the center electrode 4. The metal terminal 5 is inserted into the axial hole 2 and fixed by the connection portion 6 in a state where a portion of the metal terminal 5 is exposed from the rear side of the insulator 3. The metal terminal 5 can be formed from a metal material such as low-carbon steel.

The center electrode 4 has a rear end portion 28 that is in contact with the connection portion 6, and a rod-like portion 29 that extends from the rear end portion 28 toward the front side. The center electrode 4 is fixed within the axial hole 2 of the insulator 3 in a state where the front end thereof projects from the front end of the insulator 3, and is kept insulated from the metallic shell 7. The rear end portion 28 and the rod-like portion 29 of the center electrode 4 can be formed from a known material used for the center electrode 4, such as a Ni alloy. The center electrode 4 may be formed by: an outer layer formed from a Ni alloy or the like; and a core portion that is formed from a material having a higher coefficient of thermal conductivity than the Ni alloy and is formed so as to be concentrically embedded in an axial portion within the outer layer. Examples of the material forming the core portion include Cu, a Cu alloy, Ag, an Ag alloy, and pure Ni.

The ground electrode 8 is formed into a substantially prism shape such that: one end portion thereof is joined to a front end portion of the metallic shell 7; the ground electrode 8 is bent in the middle in a substantially L shape; and another end portion thereof is opposed to the front end of the center electrode 4 across a gap. The ground electrode 8 can be formed from a known material used for the ground electrode 8, such as a Ni alloy containing Ni as a principal component. In addition, similarly to the center electrode 4, the ground electrode 8 may be formed by: an outer layer formed from a Ni alloy or the like; and a core portion that is formed from a material having a higher coefficient of thermal conductivity than the Ni alloy and is formed so as to be concentrically embedded in an axial portion within the outer layer.

Figure 2:
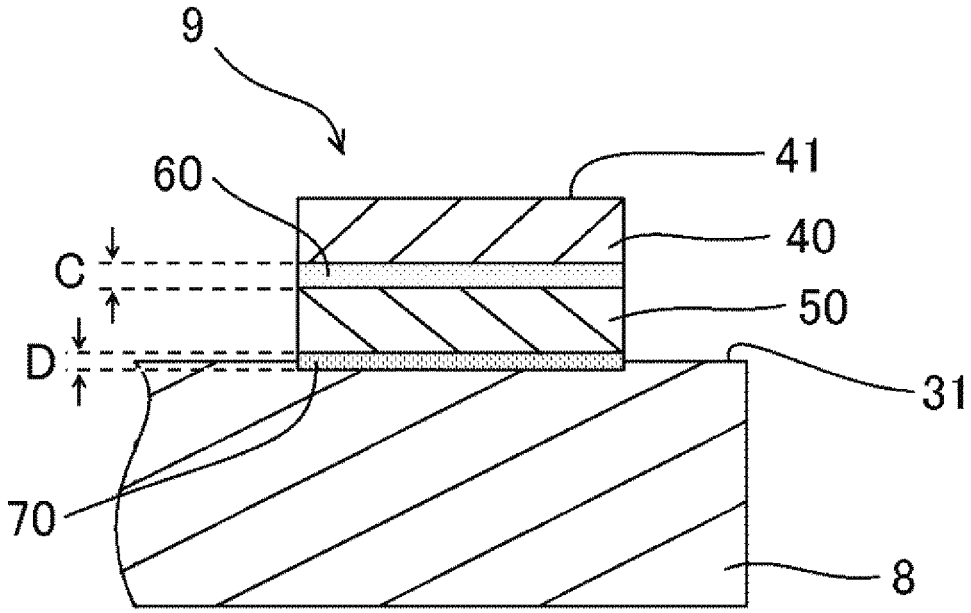
FIG. 2 is a sectional explanatory view showing, in an enlarged manner, a ground electrode and a tip of the spark plug shown in FIG. 1.

As shown in FIG. 2, the tip 9 has a disc shape in the present embodiment, and is provided on an opposed surface 31 of the ground electrode 8 that is opposed to the center electrode 4. The tip 9 has a discharge layer 40 and a relieving layer 50. The relieving layer 50 is joined to the opposed surface 31 of the ground electrode 8 via a diffusion layer 70, and the discharge layer 40 is joined via a clad diffusion layer to the side of the relieving layer 50 that is opposite to the side of the relieving layer 50 to which the ground electrode 8 is joined.

Figure 7A:
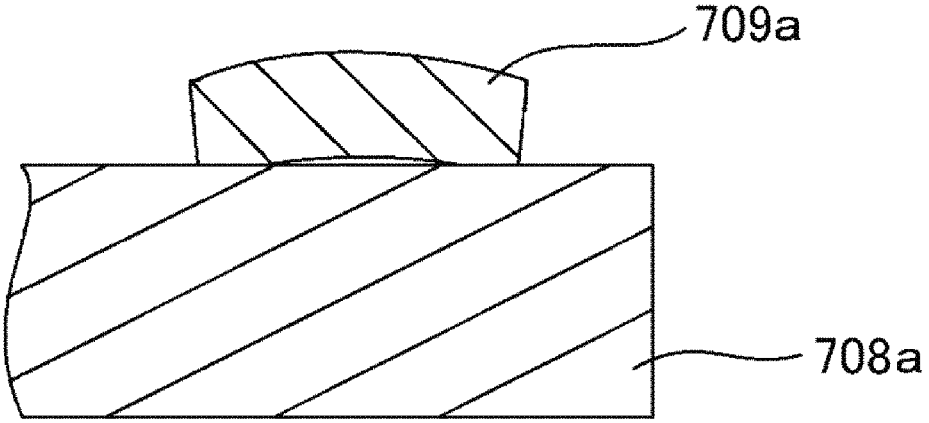
FIG. 7(*a*) is a sectional explanatory view showing a state where a disc-shaped tip formed from a Pt—Rh alloy has deformed, and FIG. 7(*b*) is a sectional explanatory view showing a state where a disc-shaped tip formed from a Pt—Ni alloy has deformed.
Figure 7B:
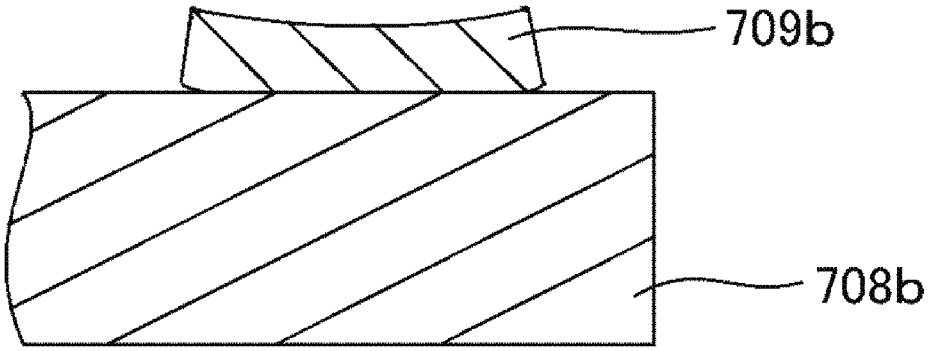

As described above, as a result of performing a durability test, under an environment in which a severe thermal cycle is repeated, for a spark plug in which a disc-shaped tip formed from a Pt—Rh alloy is joined to a ground electrode by means of solid phase diffusion joining, the inventors have found that the tip bulges at a center portion thereof to deform into a convex shape as shown in FIG. 7(*a*). When the tip deforms into a convex shape as described above, a spark discharge gap G reduces to decrease ignitability, and the tip peels off the electrode. Meanwhile, as a result of performing a durability test, under an environment in which a severe thermal cycle is repeated, for a spark plug in which a disc-shaped tip formed from a Pt—Ni alloy is joined to a ground electrode by means of solid phase diffusion joining, the inventors have found that the tip does not deform as much as a Pt—Rh alloy, but deforms at an outer peripheral portion which is held weakly by the solid phase diffusion joining, so that the shape of the tip becomes a shape in which a center portion of the tip is recessed, as shown in FIG. 7(*b*). Thus, the inventors have thought that deformation and peeling of a tip can be suppressed by integrating a Pt—Rh alloy and a Pt—Ni alloy that deform in opposite manners under an environment in which a severe thermal cycle is repeated, and have completed the present invention. That is, the inventors have formed the tip 9 by integrating the discharge layer 40 formed from a Pt—Rh alloy and the relieving layer 50 formed from a Pt—Ni alloy such that: the discharge layer 40 is disposed at a side where spark discharge is caused; and the relieving layer 50 is disposed at a side at which the ground electrode 8 is joined. In addition, in the process leading to the present invention, the inventors have found that, as described later, deformation and peeling of the tip can be suppressed only when the ratio A/B between an average cross-sectional area A of the Pt—Rh alloy and an average cross-sectional area B of the Pt—Ni alloy falls within a specific range.

Hereinafter, the tip 9 according to the present embodiment will be described in detail.

The discharge layer 40 is formed from a Pt—Rh alloy. That is, in the discharge layer 40, the Pt mass content is the highest, and the Rh mass content is the second highest. Specifically, the discharge layer 40 has a Pt content of preferably not less than 60 mass % and not greater than 95 mass %, and has a Rh content of preferably not less than 5 mass % and not greater than 40 mass %. Since the discharge layer 40 is formed from the Pt—Rh alloy, the discharge layer 40 has excellent oxidation resistance and spark wear resistance. In particular, when the Pt and Rh contents in the discharge layer 40 fall within the above ranges, the discharge layer 40 has further excellent oxidation resistance and wear resistance. The discharge layer 40 forms a discharge surface 41 for causing spark discharge between the center electrode 4 and the discharge surface 41. Since the discharge surface 41 is formed from the Pt—Rh alloy having excellent oxidation resistance and spark wear resistance, the tip 9 has excellent oxidation resistance and spark wear resistance. The total content of Pt and Rh is preferably not less than 90 mass %. When the total content of Pt and Rh is not less than 90 mass %, the wear resistance of the tip 9 can be maintained even in the case where the distance between the front end of the center electrode 4 and the discharge surface 41 of the tip 9, that is, a spark discharge gap G, is relatively large so that a load is applied to the ground electrode 8. An element contained in the tip 9 other than Pt and Rh can be, for example, at least one element selected from Ru, Pd, Ni, W, Os, Al, Y, and the like.

The relieving layer 50 is formed from a Pt—Ni alloy. That is, in the relieving layer 50, the Pt mass content is the highest, and the Ni mass content is the second highest. Specifically, the relieving layer 50 has a Pt content of preferably not less than 60 mass % and not greater than 95 mass %, and has a Ni content of preferably not less than 5 mass % and not greater than 40 mass %. Since the relieving layer 50 is formed from the Pt—Ni alloy, the relieving layer 50 has a lower melting point than the discharge layer 40, which is formed from the Pt—Rh alloy, and is inferior in spark wear resistance to the discharge layer 40. However, since the relieving layer 50 is disposed between the discharge layer 40 and the ground electrode 8 so that the relieving layer 50 is not exposed in a surface that contributes to spark discharge, the performance as an electrode almost does not diminish although the relieving layer 50 is inferior in spark wear resistance to the discharge layer 40. In addition, as described above, under an environment in which a severe thermal cycle is repeated, the relieving layer 50, which is formed from the Pt—Ni alloy, easily changes into a concave shape in which a center portion thereof is recessed. Since the tip 9 is formed by integrating the discharge layer 40, which easily changes into a convex shape, and the relieving layer 50, which easily changes into a concave shape, deformation and peeling of the tip 9 can be suppressed.

The content of each component included in the discharge layer 40 and the relieving layer 50 can be obtained as follows. First, the tip 9 is cut along a plane passing through the center of the tip 9 and parallel to a lamination direction in which the discharge layer 40 and the relieving layer 50 are laminated, thereby exposing a cut surface. This cut surface is subjected to mirror finish into a polished surface. On the polished surface of the discharge layer 40, component analysis is performed at optional 5 measuring points that are not near the boundary between the discharge layer 40 and the relieving layer 50, and the arithmetic mean of the obtained measured values is regarded as a content of each component included in the discharge layer 40. In addition, on the polished surface of the relieving layer 50, component analysis is performed at optional 5 measuring points that are not near the boundary between the discharge layer 40 and the relieving layer 50 and not near the boundary between the relieving layer 50 and the ground electrode 8, and the arithmetic mean of the obtained measured values is regarded as a content of each component included in the relieving layer 50. The component analysis is performed with a wavelength dispersive X-ray spectrometer (WDS) attached to an electron probe micro analyzer (EPMA).

Figure 3:
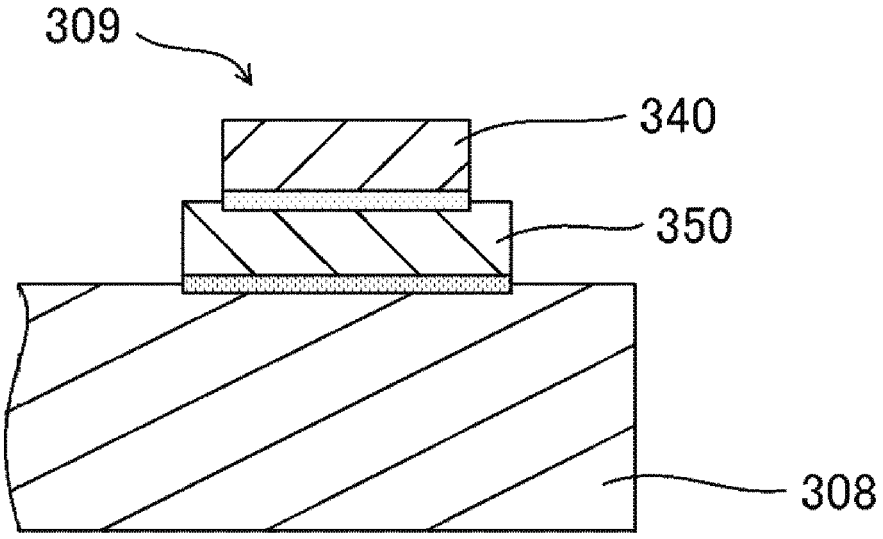
FIG. 3 is a sectional explanatory view showing a tip of another embodiment.
Figure 4:
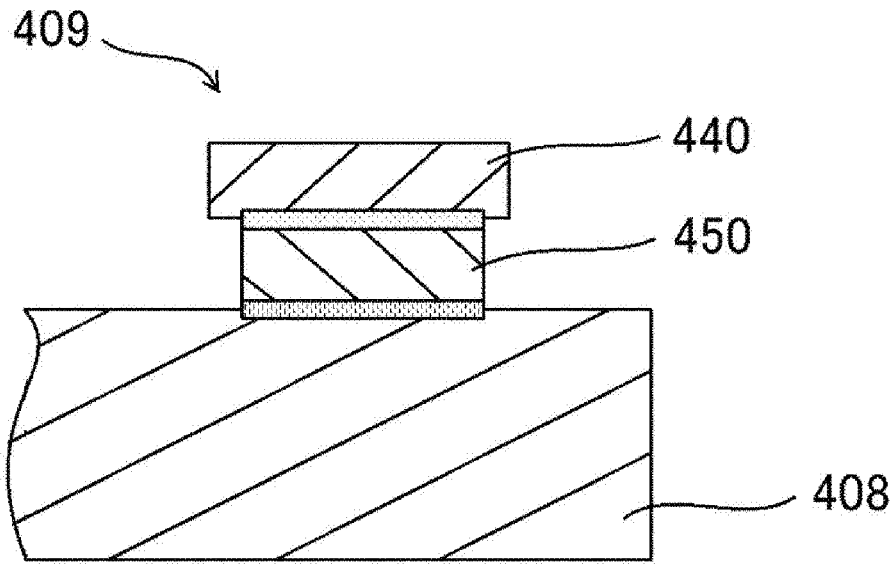
FIG. 4 is a sectional explanatory view showing a tip of still another embodiment.
Figure 5:
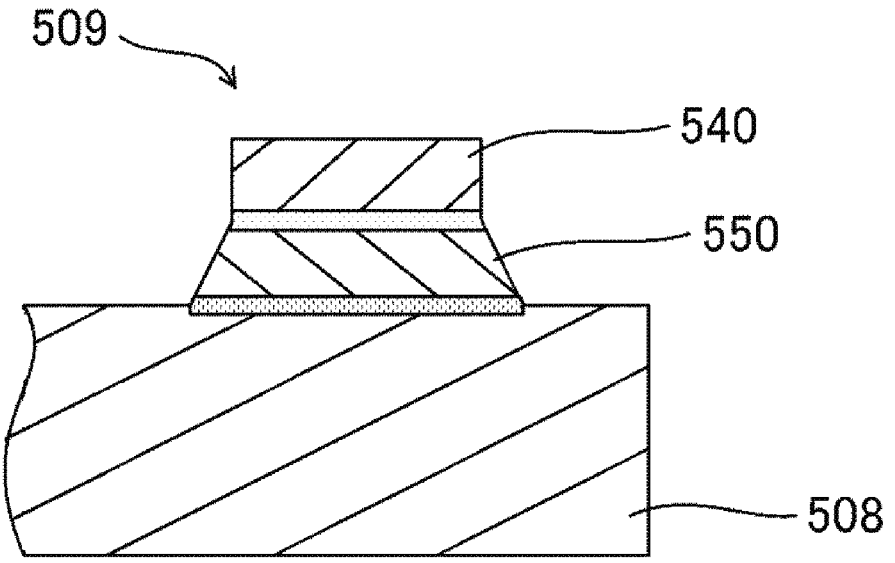
FIG. 5 is a sectional explanatory view showing a tip of still another embodiment.

The tip 9 according to the present embodiment is formed as a disc-shaped tip by joining the discharge layer 40 and the relieving layer 50 having the same shape. The shapes and/or the sizes of the discharge layer 40 and the relieving layer 50 may be different from each other. In addition, each of the shapes of the discharge layer 40 and the relieving layer 50 is not particularly limited to a disc shape, and may be an elliptical disc shape, a polygonal plate shape, a circular truncated cone shape, an elliptical truncated cone shape, a truncated pyramid shape, an inverse circular truncated cone shape, an inverse elliptical truncated cone shape, an inverse truncated pyramid shape, or the like, or a tip may be formed by optionally combining a discharge layer and a relieving layer having such different shapes and sizes. For example, a tip 309 shown in FIG. 3 is formed by laminating a disc-shaped discharge layer 340 and a disc-shaped relieving layer 350 having a larger diameter than the discharge layer 340 such that the axial lines of the discharge layer 340 and the relieving layer 350 coincide with each other. In addition, a tip 409 shown in FIG. 4 is formed by laminating a disc-shaped discharge layer 440 and a disc-shaped relieving layer 450 having a smaller diameter than the discharge layer 440 such that the axial lines of the discharge layer 440 and the relieving layer 450 coincide with each other. Moreover, a tip 509 shown in FIG. 5 is formed by laminating a disc-shaped discharge layer 540 and a circular-truncated-cone-shaped relieving layer 550 such that the axial lines of the discharge layer 540 and the relieving layer 550 coincide with each other.

The tip 9 satisfies $0.81 \leq A/B \leq 1.21$ when the average cross-sectional area of a plurality of cross-sections of the discharge layer 40 obtained when the discharge layer 40 is cut along planes parallel to the opposed surface 31 is A $mm^2$ and the average cross-sectional area of a plurality of cross-sections of the relieving layer 50 obtained when the relieving layer 50 is cut along planes parallel to the opposed surface 31 is B $mm^2$. When the tip 9, which is joined to the ground electrode 8, is exposed under an environment in which a severe thermal cycle is repeated, if A/B is less than 0.81, the discharge layer 40 easily peels off the relieving layer 50. If A/B is greater than 1.21, the tip 9 deforms into a convex shape, so that the spark discharge gap G reduces to decrease ignitability. On the other hand, if A/B is not less than 0.81 and not greater than 1.21, deformation and peeling of the tip 9 can be suppressed.

The average cross-sectional areas A and B of the discharge layer 40 and the relieving layer 50 can be obtained as follows. For the relieving layer 50, a plurality of tomographic images parallel to the opposed surface 31 are captured with an X-ray CT scanner at equal intervals from the opposed surface 31 side toward the discharge layer 40 side. The arithmetic mean of the areas of the relieving layer 50 in the plurality of captured tomographic images is regarded as the average cross-sectional area B. Similarly, for the discharge layer 40, a plurality of tomographic images parallel to the opposed surface 31 are captured with the X-ray CT scanner at equal intervals from the relieving layer 50 side toward the discharge surface 41. The arithmetic mean of the areas of the discharge layer 40 in the plurality of captured tomographic images is regarded as the average cross-sectional area A.

As shown in FIG. 2, the relieving layer 50 and the opposed surface 31 of the ground electrode 8 are joined to each other via the diffusion layer 70. The relieving layer 50 and the discharge layer 40 are joined to each other via a diffusion layer 60 (hereinafter, referred to as clad diffusion layer 60). The diffusion layer 70 is formed by joining the relieving layer 50 and the opposed surface 31 of the ground electrode 8 by means of solid phase diffusion joining. The clad diffusion layer 60 is formed by joining the relieving layer 50 and the discharge layer 40 by means of solid phase diffusion joining. Examples of solid phase diffusion joining include resistance welding, friction stir welding, and thermocompression bonding. Resistance welding is a joining method in which a large electric current is passed between members to be joined, the members are heated by generated resistance heat, and pressure is applied to the members. Friction stir welding is a joining method in which frictional heat is generated on to-be-joined surfaces of members to be joined, by rotating a joining tool while pressing the joining tool against the to-be-joined surfaces, and the joint portion between the members is softened by the frictional heat, and the members are joined to each other by stirring the joint portion. Thermocompression bonding is a joining method in which members to be joined are caused to closely adhere to each other at an appropriate temperature equal to or lower than the melting points of the members with a pressure applied thereto, thereby causing plastic deformation.

The diffusion layer 70 has a gradient composition in which the Pt content increases and/or the Ni content decreases from the ground electrode 8 side toward the relieving layer 50 side. As described above, the ground electrode 8 is formed from the Ni alloy or the like, and the relieving layer 50 is formed from the Pt—Ni alloy. Therefore, when the relieving layer 50 and the opposed surface 31 of the ground electrode 8 are joined to each other by means of solid phase diffusion joining, Pt diffuses from the relieving layer 50 toward the ground electrode 8 if the Pt content in the relieving layer 50 is higher than that in the ground electrode 8, and Ni diffuses from the ground electrode 8 toward the relieving layer 50 if the Ni content in the ground electrode 8 is higher than that in the relieving layer 50. As a result, the diffusion layer 70 having the above-described gradient composition is formed between the relieving layer 50 and the ground electrode 8.

The clad diffusion layer 60 has a gradient composition in which the Pt content increases and/or the Ni content decreases from the relieving layer 50 side toward the discharge layer 40 side. As described above, the relieving layer 50 is formed from the Pt—Ni alloy, and the discharge layer 40 is formed from the Pt—Rh alloy. Therefore, when the relieving layer 50 and the discharge layer 40 are joined to each other by means of solid phase diffusion joining, Pt diffuses from the discharge layer 40 toward the relieving layer 50 if the Pt content in the discharge layer 40 is higher than that in the relieving layer 50, and Ni diffuses from the relieving layer 50 toward the discharge layer 40 if the Ni content in the relieving layer 50 is higher than that in the discharge layer 40. As a result, the clad diffusion layer 60 having the above-described gradient composition is formed between the discharge layer 40 and the relieving layer 50.

The relieving layer 50 and the ground electrode 8 are preferably joined to each other by means of only solid phase diffusion joining. That is, preferably, only the diffusion layer 70, which is formed by solid phase diffusion joining and has the gradient composition, is formed between the relieving layer 50 and the ground electrode 8, and a melt portion formed by laser welding or the like is not present therebetween. The melt portion formed by laser welding or the like is inferior in wear resistance to the discharge layer 40. Thus, the wear resistance of the tip 9 decreases as the volume or exposed area of the melt portion increases. Therefore, from the standpoint of wear resistance, the melt portion is preferably smaller, and particularly preferably not present. In addition, when the relieving layer 50 and the ground electrode 8 are joined to each other by means of only solid phase diffusion joining and no melt portion is present, the tip 9 particularly has a high effect of suppressing deformation and peeling of the tip 9.

The discharge layer 40 and the relieving layer 50 are preferably joined to each other by means of only solid phase diffusion joining. A melt portion formed by laser welding or the like is inferior in wear resistance to the discharge layer 40. Thus, the wear resistance of the tip 9 decreases as the volume or exposed area of the melt portion increases. Therefore, preferably, the discharge layer 40 and the relieving layer 50 are joined to each other by means of only solid phase diffusion joining, and no melt portion is present.

The formation of the diffusion layers 60 and 70 between the discharge layer 40 and the relieving layer 50 and between the relieving layer 50 and the ground electrode 8, respectively, can be confirmed, for example, by: performing element analysis with the WDS, attached to the EPMA, on a polished surface obtained by exposing a cut surface and performing mirror finish on the cut surface at the joint portion in the same manner as in measuring the content of each component included in the discharge layer 40 and the relieving layer 50 as described above; and observing, with a metallograph, a polished surface obtained by electrolytic etching with oxalic acid dehydrate after the mirror finish. Each of the diffusion layer 70 and the clad diffusion layer 60 normally has a thickness of about several hundred micrometers. The diffusion layer 70 and the clad diffusion layer 60 each having a gradient composition can be confirmed as a region where Pt and/or Ni diffuses from one member of adjacent members at both sides of the diffusion layer 60 or 70 to the other member and the Pt and/or Ni mass content continuously or stepwise increases or decreases from the one member side toward the other member side, when mapping analysis is performed on the polished surface with the WDS attached to the EPMA. In addition, in the case where, as with resistance welding and thermocompression bonding, pressure is applied to members to be joined to cause plastic deformation thereby to join the members, it is observed that the members plastically deform to closely adhere to each other. In the case where a melt portion is formed as with laser welding or the like, when the melt portion is observed with a metallograph, a unique crystal structure formed after a melt of members to be joined is solidified, such as a dendrite structure, is observed over the entire area of the melt portion, or a marble melt alloy layer obtained by mixing the members is observed over the entire area of the melt portion. In the case with solid phase diffusion joining, since members to be joined are joined at a temperature equal to or lower than the melting points of the members, when the diffusion layers 60 and 70 are observed with a metallograph, a crystal structure, such as a dendrite structure, or a marble melt alloy layer obtained by mixing the members may be observed in portions of the diffusion layers 60 and 70, but is not observed in the entire areas of the diffusion layers 60 and 70.

The tip 9 preferably satisfies C>D when the thickness of the clad diffusion layer 60 is C μm and the thickness of the diffusion layer 70 is D μm.

The tip 9 and the ground electrode 8 have two joint portions, that is, a joint portion between the discharge layer 40 and the relieving layer 50 and a joint portion between the relieving layer 50 and the ground electrode 8. When peeling occurs at one of the joint portions, entire stress is relieved, so that peeling at the other joint portion is suppressed. In the case of C≤D, the joining strength between the discharge layer 40 and the relieving layer 50 easily becomes less than the joining strength between the relieving layer 50 and the ground electrode 8, so that crack easily occurs between the discharge layer 40 and the relieving layer 50. The clad diffusion layer 60, which is the joint portion between the discharge layer 40 and the relieving layer 50, is disposed in the interior of a combustion chamber and exposed in a severe environment as compared to the diffusion layer 70, which is the joint portion between the relieving layer 50 and the ground electrode 8. Thus, when crack occurs between the discharge layer 40 and the relieving layer 50, there is a higher possibility that the crack develops so that the tip falls off, than when crack occurs between the relieving layer 50 and the ground electrode 8. Therefore, when C>D is satisfied, that is, the thickness C of the clad diffusion layer 60 is larger than the thickness D of the diffusion layer 70, occurrence of crack in the joint portion between the discharge layer 40 and the relieving layer 50, which is exposed in a severe environment, can be suppressed more, and development of crack and falling-off of the tip can be suppressed more.

Each of the thicknesses of the clad diffusion layer 60 and the diffusion layer 70 can be adjusted by changing the conditions of solid phase diffusion joining, such as an electric current value, a heating temperature, and a processing time, as appropriate.

Figure 8:
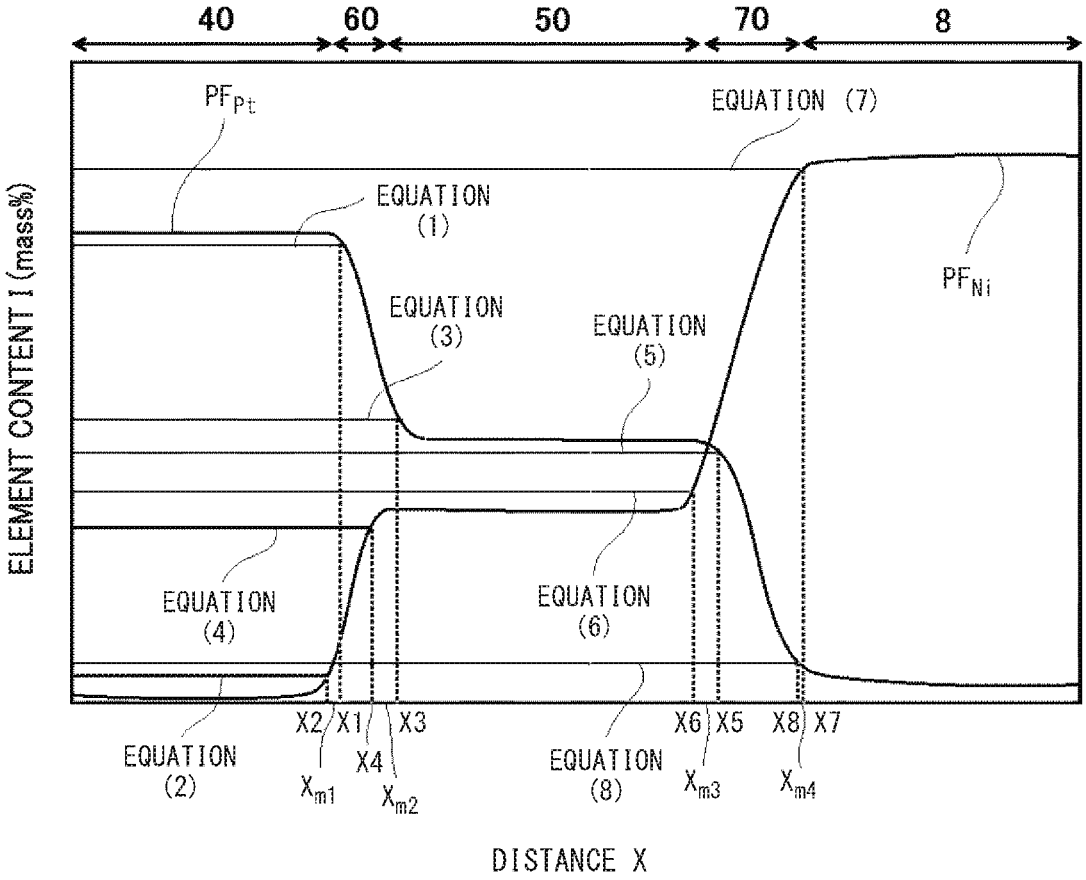
FIG. 8 is a schematic explanatory diagram showing a relationship between an element content I and a distance X of an analysis line when line analysis was performed on a polished surface of a tip with a WDS attached to an EPMA.

Each of the thicknesses of the clad diffusion layer 60 and the diffusion layer 70 can be obtained as follows. First, in the same manner as in measuring the content of each component included in the discharge layer 40 and the relieving layer 50 as described above, a cut surface is exposed and subjected to mirror finish into a polished surface. On the polished surface, an analysis line is set in the lamination direction of the discharge layer 40 and the relieving layer 50, and characteristic X-rays are measured along the analysis line with the WDS attached to the EPMA, to obtain, for example, a line analysis profile shown in FIG. 8. The vertical axis indicates element content I (mass %), and the horizontal axis indicates distance X measured along the analysis line. In FIG. 8, a line analysis profile $PF_{Pt}$ of Pt and a line analysis profile $PF_{Ni}$ of Ni are shown. For noise reduction, variation components having a minute characteristic X-ray intensity with a wavelength of less than 1 μm are preferably removed from the obtained line analysis profiles by filtering.

Next, on each of polished surfaces of the discharge layer 40, the relieving layer 50, and the ground electrode 8, the Pt and Ni contents (mass %) are measured at least optional three measuring points in the vicinity of the center of each layer, that is, away by 0.05 mm or more from the boundary with another layer and the surface of each layer. The arithmetic mean of the obtained measured values is obtained, the Pt content in the discharge layer 40 is denoted by $I_{Pt1}$, the Ni content in the discharge layer 40 is denoted by $I_{Ni1}$, the Pt content in the relieving layer 50 is denoted by $I_{Pt2}$, the Ni content in the relieving layer 50 is denoted by $I_{Ni2}$, the Pt content in the ground electrode 8 is denoted by $I_{Pt3}$, and the Ni content in the ground electrode 8 is denoted by $I_{Ni3}$.

In FIG. 8, the x coordinate of the intersection point of the line analysis profile $PF_{Pt}$ of Pt and a straight line represented by equation (1), Pt content $I=I_{Pt1}-0.03\times(I_{Pt1}-I_{Pt2})$, is denoted by $x_1$; the x coordinate of the intersection point of the line analysis profile $PF_{Ni}$ of Ni and a straight line represented by equation (2), Ni content $I=I_{Ni1}\times0.03\times(I_{Ni2}-I_{Ni1})$, is denoted by $x_2$; and the average of these values is regarded as an x coordinate $x_{m1}$ $(=(x_1+x_2)/2)$ of the boundary between the discharge layer 40 and the clad diffusion layer 60. In addition, similarly, the x coordinate of the intersection point of the line analysis profile $PF_{Pt}$ of Pt and a straight line represented by equation (3), Pt content $I=I_{Pt2}+0.03\times(I_{Pt1}-I_{Pt2})$, is denoted by $x_3$; the x coordinate of the intersection point of the line analysis profile $PF_{Ni}$ of Ni and a straight line represented by equation (4), Ni content $I=I_{Ni2}-0.03\times(I_{Ni2}-I_{Ni1})$, is denoted by $x_4$; and the average of these values is regarded as an x coordinate $x_{m2}$ $(=(x_3+x_4)/2)$ of the boundary between the clad diffusion layer 60 and the relieving layer 50.

Furthermore, the x coordinate of the intersection point of the line analysis profile $PF_{Pt}$ of Pt and a straight line represented by equation (5), Pt content $I=I_{Pt2}-0.03\times(I_{Pt2}-I_{Pt3})$, is denoted by $x_5$; the x coordinate of the intersection point of the line analysis profile $PF_{Ni}$ of Ni and a straight line represented by equation (6), Ni content $I=I_{Ni2}+0.03\times(I_{Ni3}-I_{Ni2})$, is denoted by $x_6$; and the average of these values is regarded as an x coordinate $x_{m3}$ $(=(x_5+x_6)/2)$ of the boundary between the relieving layer 50 and the diffusion layer 70. In addition, similarly, the x coordinate of the intersection point of the line analysis profile $PF_{Pt}$ of Pt and a straight line represented by equation (7), Pt content $I=I_{Pt3}+0.03\times(I_{Pt2}-I_{Pt3})$, is denoted by $x_7$; the x coordinate of the intersection point of the line analysis profile $PF_{Ni}$ of Ni and a straight line represented by equation (8), Ni content $I=I_{Ni3}-0.03\times(I_{Ni3}-I_{Ni2})$, is denoted by $x_8$; and the average of these values is regarded as an x coordinate $x_{m4}$ $(=(x_7+x_8)/2)$ of the boundary between the diffusion layer 70 and the ground electrode 8.

The thickness $t_1$ of the clad diffusion layer 60 is calculated by $t_1=|x_{m1}-x_{m2}|$, and the thickness $t_2$ of the diffusion layer 70 is calculated by $t_2=|x_{m3}-x_{m4}|$.

When the thicknesses $t_1$ and $t_2$ vary depending on the set position of the analysis line, preferably, the position of the analysis line is changed as appropriate, the Pt and Ni contents (mass %) are measured on a plurality of analysis lines, the thicknesses $t_1$ and $t_2$ are calculated as described above, and the arithmetic means of the obtained values are regarded as a final thickness $t_1$ of the clad diffusion layer 60 and a final thickness $t_2$ of the diffusion layer 70.

Figure 6:
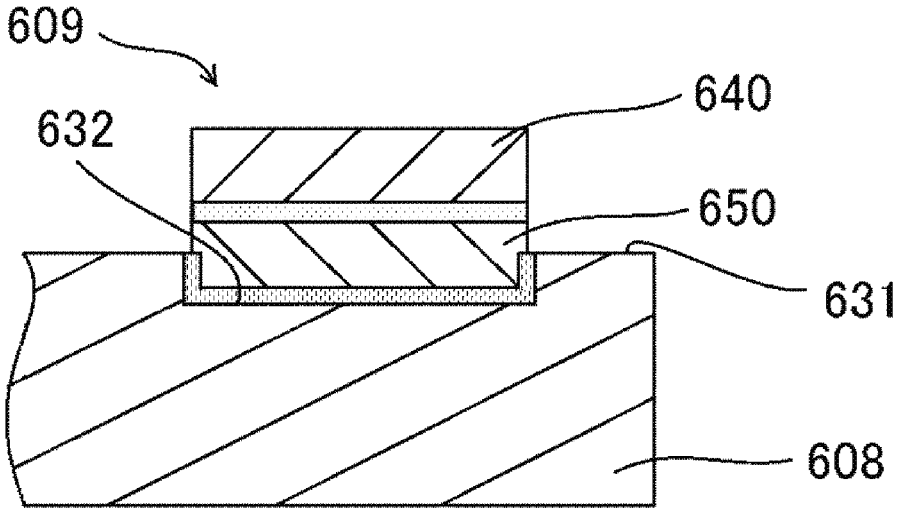
FIG. 6 is a sectional explanatory view showing a tip of still another embodiment.

The tip 9 is joined to the flat opposed surface 31 of the ground electrode 8. However, as shown in FIG. 6, an opposed surface 631 may have a recess 632 with a bottom, a tip 609 may be fitted in the recess 632, and a relieving layer 650 may be joined to the recess 632 via a diffusion layer 670 formed by solid phase diffusion joining. The recess 632 has a shape complementary to the shape of the relieving layer 650, and is formed, for example, by cutting the opposed surface 631 toward a direction orthogonal to the opposed surface 631. In addition, in another mode, a tip may be embedded in a ground electrode by pressing the tip against an opposed surface of the ground electrode while passing an electric current.

In the present embodiment, a tip is not provided on the center electrode 4, but tips may be provided on both the center electrode 4 and the ground electrode 8. In the case where a tip is provided on the center electrode 4, the tip provided on the center electrode 4 only needs to be formed from a known material used as a tip and be joined to the center electrode 4 by a known joining method. The spark discharge gap G in the spark plug 1 according to the present embodiment indicates the shortest distance between the front end of the center electrode 4 and the discharge surface 41 of the tip 9 opposed to the center electrode 4. In the case where a tip is provided on the center electrode 4, the spark discharge gap G indicates the shortest distance between the front end of the tip provided on the center electrode 4 and the discharge surface of the tip provided on the ground electrode 8. The spark discharge gap G is normally set to 0.3 to 1.5 mm, and spark discharge occurs with the spark discharge gap G.

The spark plug 1 includes the tip 9 that has: the discharge layer 40 formed from the Pt—Rh alloy, which tends to deform into a convex shape; and the relieving layer 50 formed from the Pt—Ni alloy, which tends to deform into a concave shape, and the ratio A/B between the average cross-sectional area A of the discharge layer 40 and the average cross-sectional area B of the relieving layer 50 satisfies $0.81 \leq A/B \leq 1.21$. Thus, deformation and peeling of the tip 9 can be suppressed. In addition, since the discharge layer 40, which is formed from the Pt—Rh alloy, is disposed at the side where spark discharge is caused, the spark plug 1 has excellent spark wear resistance and oxidation resistance. Furthermore, the discharge layer 40 and the relieving layer 50 are joined to each other by means of solid phase diffusion joining, and the relieving layer 50 and the ground electrode 8 are joined to each other by means of solid phase diffusion joining, so that the volume of the melt portion is small. Thus, the spark plug 1 has excellent wear resistance.

The spark plug 1 is produced, for example, as follows.

Each of the ground electrode 8 and the center electrode 4 is produced, for example, by: preparing a molten metal of an alloy having a desired composition by using a vacuum melting furnace; performing drawing processing or the like; and performing adjustment to a predetermined shape and a predetermined dimension as appropriate. In the case of embedding the tip 609 in the ground electrode 608 as shown in FIG. 6, the recess 632 is formed by means of cutting or the like. In the case of embedding the tip 609 in the ground electrode 608 by means of resistance welding or the like, the recess 632 may not be formed. In the case of forming the ground electrode 8 by an outer layer and a core portion provided so as to be embedded in an axial portion of the outer layer, the ground electrode 8 having the core portion within the outer layer is formed by: inserting, into an outer material formed in a cup shape from a Ni alloy or the like, an inner material formed from a Cu alloy or the like having a higher coefficient of thermal conductivity than the outer material; and performing plastic processing such as extruding. Similarly to the ground electrode 8, the center electrode 4 may be formed by an outer layer and a core portion. In this case, the center electrode 4 can be obtained by inserting an inner material into an outer material formed in a cup shape and performing plastic processing such as extruding similarly to the ground electrode 8, and then performing plastic processing into a substantially prism shape.

Next, one end of the ground electrode 8 is joined by means of electric resistance welding and/or laser welding or the like to the front end of the metallic shell 7 which is formed into a predetermined shape by plastic processing or the like.

For the tip 9, first, a disc body that is to be the discharge layer 40 and a disc body that is to be the relieving layer 50 are produced. For example, for forming the disc body that is to be the discharge layer 40, a method in which a melting material obtained by blending and melting a tip material containing at least Pt and Rh is processed into a plate, for example, by means of rolling, and the plate is punched out into a predetermined shape by means of stamping, a method in which an alloy containing at least Pt and Rh is processed into a wire-like or rod-like material by means of rolling, forging, or drawing, and then this material is cut into a predetermined length in the longitudinal direction thereof, and the like can be adopted. In the same manner as for the discharge layer 40, the disc body that is to be the relieving layer 50 can be produced.

Next, the disc body that is to be the discharge layer 40 and the disc body that is to be the relieving layer 50 are joined to each other by means of solid phase diffusion joining to produce the tip 9. Next, the relieving layer 50 of the produced tip 9 and the opposed surface 31 of the produced ground electrode 8 are joined to each other by means of solid phase diffusion joining. According to this method, the thicknesses C and D can be easily adjusted such that the thickness C of the clad diffusion layer 60 is larger than the thickness D of the diffusion layer 70. Since the clad diffusion layer 60 is disposed in the interior of the combustion chamber and exposed in a severe environment as compared to the diffusion layer 70, when crack occurs in the clad diffusion layer 60, there is a higher possibility that the crack develops so that the tip 9 peels off, than when crack occurs in the diffusion layer 70. According to the method for producing the spark plug 1, since the clad diffusion layer 60 and the diffusion layer 70 can be easily formed such that the thickness C of the clad diffusion layer 60 is larger than the thickness D of the diffusion layer 70, occurrence of crack in the clad diffusion layer 60, which is exposed in a severe environment, can be suppressed, and development of crack and peeling of the tip 9 can be suppressed.

As another method different from the above method, a method may be adopted in which, after the disc body to be the relieving layer 50 and the opposed surface 31 of the ground electrode 8 are joined to each other by means of solid phase diffusion joining, the disc body that is to be the discharge layer 40 is laminated on the surface of the relieving layer 50 at the side opposite to the side at which the ground electrode 8 is joined, and is joined thereto by means of solid phase diffusion joining. Other than the above methods, a method may be adopted in which, after melting materials obtained by blending and melting a tip material containing at least Pt and Rh and a tip material containing at least Pt and Ni are processed into plates by means of rolling or the like and solid phase diffusion joining is performed, and the plates are punched out into a predetermined shape by means of stamping. For improving the degree of adhesion of each layer, a method can also be adopted in which each diffusion layer is formed to be thick by heat treatment.

Meanwhile, the insulator 3 is produced by baking a ceramic material or the like into a predetermined shape, the center electrode 4 is inserted into the axial hole 2 of the insulator 3, and the axial hole 2 is filled with a composition forming the connection portion 6, under preliminary compression. Next, the composition is compressed and heated while the metal terminal 5 is pressed in through an end portion in the axial hole 2. Thus, the composition is sintered to form the connection portion 6. Next, the insulator 3 to which the center electrode 4 and the like have been fixed is assembled to the metallic shell 7 to which the ground electrode 8 has been joined. At the end, a front end portion of the ground electrode 8 is bent to the center electrode 4 side such that the discharge surface 41 of the tip 9 joined to the ground electrode 8 is opposed to the front end of the center electrode 4, so that the spark plug 1 is produced.

The spark plug 1 according to the present invention is used as an ignition plug for an internal combustion engine for an automobile, such as a gasoline engine. The spark plug 1 is fixed at a predetermined position by the screw portion 24 being screwed into a screw hole provided in a head (not shown) that defines a combustion chamber of the internal combustion engine. The spark plug 1 according to the present invention can be used for any internal combustion engine. The spark plug 1 according to the present invention is particularly suitable for an internal combustion engine in which a spark plug is exposed in an environment in which a severe thermal cycle is repeated.

The spark plug 1 according to the present invention is not limited to the above-described embodiment, and various changes can be made as long as the purpose of the present invention can be accomplished.

EXAMPLES

1. Thermal Cycle Test

Production of Samples

A sample was produced by joining each tip shown in Table 1 to a square material formed from NCF601, by means of resistance welding. Each of the tips of test Nos. 1 to 3 and 24 to 26 shown in Table 1 is a tip having a composition shown in Table 1 as a whole. Each of the tips of test Nos. 4 to 23 and 27 to 29 shown in Table 1 is a clad tip having a discharge layer and a relieving layer. The clad tip was produced by: preparing a disc body or polygonal plate body that is to be a discharge layer having a composition shown in Table 1 and a disc body or polygonal plate body that is to be a relieving layer having a composition shown in Table 1; and joining both bodies by means of resistance welding. In joining the clad tip to the square material, the relieving layer was brought into contact with the square material, and the clad tip is joined to the square material by means of resistance welding.

Each of the average cross-sectional areas A and B in the tips of test Nos. 4 to 23 and 27 to 29 was obtained by arithmetic mean of a plurality of tomographic images obtained by using an X-ray CT scanner (TOSCANER-32300μFD, manufactured by Toshiba Corporation) as described above. The ratio (A/B) of the average cross-sectional area A relative to the average cross-sectional area B was calculated and is shown in Table 1.

When the densities of the discharge layer and the relieving layer are close to each other, it is difficult to identify the layers with the X-ray CT scanner. Thus, in such a case, a composition was confirmed with an energy dispersive X-ray analyzer (EDS: energy dispersive spectrometer) (IT 300, manufactured by JEOL Ltd.) attached to a scanning electron microscope (SEM), on a polished surface obtained by performing mirror finish on a cut surface of a tip that had been cut along a plane passing through the center of the tip and parallel to the lamination direction of the discharge layer and the relieving layer, and then the average cross-sectional areas A and B were obtained by arithmetic mean of cross-sectional images obtained with the X-ray CT scanner.

For the composition of the tip, as described above, the tip was cut along a plane passing through the center of the tip and parallel to the lamination direction of the discharge layer and the relieving layer, the cut surface of the tip was subjected to mirror finish into a polished surface, component analysis was performed on the polished surface at optional five measuring points near the center of the polished surface, and near the centers of the discharge layer and the relieving layer in the case of a clad tip, and the arithmetic mean of the obtained measured values was regarded as a composition of each of the tip, the discharge layer, and the relieving layer. The component analysis was performed with a wavelength dispersive X-ray spectrometer (WDS) (JXA-8500F, manufactured by JEOL Ltd.) attached to an electron probe micro analyzer (EPMA) at a set acceleration voltage of 20 kV and at a set spot diameter of 100 μm. In Table 1, for example, "Pt-20Rh" indicates that the Rh content is 20 mass % and the remainder is Pt.

In addition, when mapping analysis was performed on the polished surface with the WDS attached to the EPMA, diffusion layers having a thickness of several hundred micrometers were confirmed between the discharge layer and the relieving layer and between the relieving layer and the ground electrode. Each of the diffusion layers had a gradient composition in which the Pt content and/or Ni content increases or decreases from one member side of adjacent members at both sides to the other member side.

The thickness C of the clad diffusion layer between the discharge layer and the relieving layer and the thickness D of the diffusion layer between the relieving layer and the opposed surface of the square material were obtained as described above. First, a polished surface of the tip was obtained in the same manner as in obtaining the composition of the tip, an analysis line was set on this polished surface in the lamination direction of the discharge layer and the relieving layer, and characteristic X-rays were measured along the analysis line with the WDS attached to the EPMA, to obtain line analysis profiles $PF_{Pt}$ and $PF_{Ni}$. In addition, the average values $I_{Pt1}$, $I_{Pt2}$, $I_{Pt3}$, $I_{Ni1}$, $I_{Ni2}$, and $I_{Ni3}$ of the Pt and Ni contents (mass %) near the centers of the discharge layer, the relieving layer, and the square material were obtained as described above. The thickness C of the clad diffusion layer and the thickness D of the diffusion layer were obtained from these values and the line analysis profiles $PF_{Pt}$ and $PF_{Ni}$ as described above.

Thermal Cycle Test Method

A thermal cycle test was performed in which 1000 cycles were performed with, as 1 cycle, a cycle in which each produced sample was heated with a burner, kept at 1100° C. for 120 seconds, and allowed to cool for 60 seconds.

Deformation Amount of Tip

A direction orthogonal to a surface of the square material to which the tip was joined is denoted by Y, and, with a point on this surface as 0, a direction in which the tip was located is positive. After the thermal cycle test, values of Y were measured on a surface of the tip at the side opposite to the side joined to the square material, and at a portion having a maximum Y value and a portion having a minimum Y value, and the difference between the maximum value and the minimum value was regarded as a deformation amount. In Table 1, a deformation amount when the Y value was larger at the center portion of the tip than at the end portion of the tip is shown as positive, and a deformation amount when the Y value was smaller at the center portion of the tip than at the end portion of the tip is shown as negative.

Tip Deformation Suppression Effect

The tip deformation suppression effect was evaluated according to the following criteria on the basis of the absolute value of "Deformation amount of tip" shown in Table 1, and is shown in Table 1.

Poor: The deformation amount is equal to or greater than 40 μm.

Fair: The deformation amount is equal to or greater than 20 μm and less than 40 μm.

Good: The deformation amount is equal to or greater than 10 μm and less than 20 μm.

Excellent: The deformation amount is less than 10 μm.

Tip Peeling Property Evaluation

After the thermal cycle test, each sample was buried into a resin, and was cut along a plane passing through the axial line of the tip so as to allow the diameter of the tip to be measured. A width f of a portion, at the joint portion between the relieving layer and the square material, where both members were joined to each other without a gap, and a width g of a portion, at the joint portion between the relieving layer and the discharge layer, where both members were joined to each other without a gap, were measured. With the width of the tip as E, a peeling ratio X of the joint portion between the relieving layer and the square material and a peeling ratio Y of the joint portion between the relieving layer and the discharge layer were calculated according to the following equations.

$$X=\{(E-f)/E\}\times 100(\%)$$

$$Y=\{(E-g)/E\}\times 100(\%)$$

The tip peeling property was evaluated according to the following criteria on the basis of the peeling ratios X and Y, and is shown in Table 1.

Poor: The value of X or Y is equal to or greater than 50%.

Fair: The value of X or Y is equal to or greater than 30% and less than 50%.

Good: The value of X or Y is equal to or greater than 10% and less than 30%.

Excellent: The value of X or Y is less than 10%.

2. Durability Test

Production of Spark Plug

A spark plug having the same shape as that of the spark plug shown in FIG. 1 was produced. The tip was produced in the same manner as in "1. Thermal cycle test", and was joined to a ground electrode made of Inconel 601, by means of resistance welding.

Durability Test Method

The produced spark plug was mounted to an in-line 4-cylinder turbo engine having a displacement of 2.0 liters, and the engine was operated at full throttle for 200 hours under conditions of an air/fuel ratio of 12.0 and a suction negative pressure of 190 kPa.

Tip Wear Property Evaluation

The spark discharge gap G was measured with a pin gauge before and after the durability test, and an increase amount of the spark discharge gap G was calculated. The tip wear property was evaluated according to the following criteria on the basis of the increase amount of the spark discharge gap G, and is shown in Table 1. In the "Wear property" section in Table 1, the spark discharge gap G before the durability test was 0.75 mm in the case of "Normal conditions", and the spark discharge gap G before the durability test was 1.05 mm in the case of "High load".

Case of "Normal Conditions"

Poor: The increase amount of the spark discharge gap G is equal to or greater than 0.20 mm.

Fair: The increase amount of the spark discharge gap G is equal to or greater than 0.165 mm and less than 0.2 mm.

Good: The increase amount of the spark discharge gap G is equal to or greater than 0.15 mm and less than 0.165 mm.

Excellent: The increase amount of the spark discharge gap G is less than 0.15 mm.

Case of "High Load"

Poor: The increase amount of the spark discharge gap G is equal to or greater than 0.30 mm.

Fair: The increase amount of the spark discharge gap G is equal to or greater than 0.20 mm and less than 0.30 mm.

Good: The increase amount of the spark discharge gap G is equal to or greater than 0.165 mm and less than 0.20 mm.

Excellent: The increase amount of the spark discharge gap G is equal to or greater than 0.15 mm and less than 0.165 mm.

Outstanding: The increase amount of the spark discharge gap G is less than 0.15 mm.

Overall Evaluation

In Table 1, with "Outstanding" giving 4 points, "Excellent" giving 3 points, "Good" giving 2 points, "Fair" giving 1 point, and "Poor" giving 0 point, a total score of the points of the respective evaluation items of each sample was obtained, and each sample was evaluated according to the following criteria on the basis of the total score. When there is "Poor" even in one of the respective evaluation items, the overall evaluation was regarded as "Poor" regardless of the total score.

Poor: 0 to 10 points

Fair: 11 to 15 points

Good: 15 to 17 points

Excellent: 18 points

Outstanding: 19 points

TABLE 1

| | Configuration of tip | | | | | Evaluation results | |
|---|---|---|---|---|---|---|---|
| | | Composition (mass %) | | Area | Diffusion layer thickness | Deformation property | |
| Test No. | Shape | Discharge layer | Relieving layer | ratio A/B | ratio C/D | Deformation amount of tip (μm) | Deformation suppression effect |
| 1 | Disc | Pt—20Rh | | — | — | 40 | Poor |
| 2 | Disc | Pt—10Ni | | — | — | −15 | Good |
| 3 | Disc | Pt—20Ir | | — | — | −10 | Good |
| 4 | Disc | Pt—20Rh | Pt | 1 | >1 | 80 | Poor |
| 5 | Disc | Pt—20Rh | Pt—5Au | 1 | >1 | 65 | Poor |
| 6 | Disc | Ir | Pt—10Ni | 1 | >1 | 3 | Excellent |
| 7 | Disc | Pt—20Ir | Pt—10Ni | 1 | >1 | 3 | Excellent |
| 8 | Disc | Pt—20Rh | Pt—10Ni | 1 | >1 | 3 | Excellent |
| 9 | Disc | Pt—20Rh | Pt—20Ni | 1 | >1 | 1 | Excellent |
| 10 | Disc | Pt—20Rh | Pt—40Ni | 1 | >1 | 3 | Excellent |
| 11 | Disc | Pt—20Rh—1Ni | Pt—10Ni | 1 | >1 | 3 | Excellent |
| 12 | Disc | Pt—20Rh—5Ni | Pt—10Ni | 1 | >1 | 1 | Excellent |
| 13 | Disc | Pt—20Rh—10Ni | Pt—10Ni | 1 | >1 | 0 | Excellent |
| 14 | Disc | Pt—20Rh—12Ni | Pt—10Ni | 1 | >1 | 0 | Excellent |
| 15 | Disc | Pt—20Rh—15Ni | Pt—10Ni | 1 | >1 | 0 | Excellent |
| 16 | Disc | Pt—20Rh | Pt—20Ni | 1.32 | >1 | 50 | Poor |
| 17 | Disc | Pt—20Rh | Pt—20Ni | 1.21 | >1 | 5 | Excellent |
| 18 | Disc | Pt—20Rh | Pt—20Ni | 1.10 | >1 | 1 | Excellent |
| 19 | Disc | Pt—20Rh | Pt—20Ni | 0.90 | >1 | 1 | Excellent |
| 20 | Disc | Pt—20Rh | Pt—20Ni | 0.81 | >1 | 1 | Excellent |
| 21 | Disc | Pt—20Rh | Pt—20Ni | 0.72 | >1 | 1 | Excellent |
| 22 | Disc | Pt—20Rh | Pt—20Ni | 1 | 1 | 1 | Excellent |
| 23 | Disc | Pt—20Rh | Pt—20Ni | 1 | <1 | 1 | Excellent |
| 24 | Prism | Pt—20Rh | | — | — | 40 | Poor |
| 25 | Prism | Pt—10Ni | | — | — | −15 | Good |
| 26 | Prism | Pt—20Ir | | — | — | −10 | Good |
| 27 | Prism | Pt—20Rh | Pt—10Ni | 1 | >1 | 3 | Excellent |
| 28 | Prism | Pt—20Rh | Pt—20Ni | 1 | >1 | 1 | Excellent |
| 29 | Prism | Pt—20Rh | Pt—40Ni | 1 | >1 | 3 | Excellent |

TABLE 1-continued

| | Evaluation results | | | | | |
|---|---|---|---|---|---|---|
| | Peeling property | | | Wear property | | |
| Test No. | Joint portion between relieving layer and ground electrode | Joint portion between relieving layer and discharge layer | Peeling property overall evaluation | Normal conditions | High load | Overall evaluation |
| 1 | Poor | — | Poor | Excellent | Outstanding | Poor |
| 2 | Excellent | — | Excellent | Poor | Poor | Poor |
| 3 | Poor | — | Poor | Good | Poor | Poor |
| 4 | Poor | Excellent | Poor | Excellent | Outstanding | Poor |
| 5 | Poor | Excellent | Poor | Excellent | Outstanding | Poor |
| 6 | Excellent | Excellent | Excellent | Poor | Poor | Poor |
| 7 | Excellent | Excellent | Excellent | Good | Poor | Poor |
| 8 | Excellent | Excellent | Excellent | Excellent | Outstanding | Outstanding |
| 9 | Excellent | Excellent | Excellent | Excellent | Outstanding | Outstanding |
| 10 | Excellent | Excellent | Excellent | Excellent | Outstanding | Outstanding |
| 11 | Excellent | Excellent | Excellent | Excellent | Outstanding | Outstanding |
| 12 | Excellent | Excellent | Excellent | Excellent | Outstanding | Outstanding |
| 13 | Excellent | Excellent | Excellent | Excellent | Outstanding | Outstanding |
| 14 | Excellent | Excellent | Excellent | Excellent | Excellent | Excellent |
| 15 | Excellent | Excellent | Excellent | Excellent | Excellent | Excellent |
| 16 | Excellent | Excellent | Excellent | Excellent | Outstanding | Poor |
| 17 | Excellent | Excellent | Excellent | Excellent | Outstanding | Outstanding |
| 18 | Excellent | Excellent | Excellent | Excellent | Outstanding | Outstanding |
| 19 | Excellent | Excellent | Excellent | Excellent | Outstanding | Outstanding |
| 20 | Excellent | Excellent | Excellent | Excellent | Outstanding | Outstanding |
| 21 | Excellent | Poor | Poor | Excellent | Outstanding | Poor |
| 22 | Excellent | Good | Good | Excellent | Outstanding | Good |
| 23 | Excellent | Good | Good | Excellent | Outstanding | Good |
| 24 | Poor | — | Poor | Excellent | Outstanding | Poor |
| 25 | Excellent | — | Excellent | Poor | Poor | Poor |
| 26 | Poor | — | Poor | Good | Poor | Poor |
| 27 | Excellent | Excellent | Excellent | Excellent | Outstanding | Outstanding |
| 28 | Excellent | Excellent | Excellent | Excellent | Outstanding | Outstanding |
| 29 | Excellent | Excellent | Excellent | Excellent | Outstanding | Outstanding |

As shown in Table 1, in each of the samples of test Nos. 8 to 15, 17 to 20, 22, 23, and 27 to 29 which fall within the scope of claim 1 according to the present invention, the test results were favorable for the deformation property, peeling property, and the wear property of the tip, so that the overall evaluation was favorable. On the other hand, in each of the samples of test Nos. 1 to 7, 16, 21, and 24 to 26 which do not fall within the scope of claim 1 according to present invention, the test results were poor for at least one of the deformation property, peeling property, and the wear property of the tip, so that the overall evaluation was poor. Hereinafter, each sample will be specifically described.

When test Nos. 1 and 2 and test Nos. 8 to 10 are compared, the sample of test No. 1 including a tip made of a Pt-20Rh alloy had excellent wear resistance, but deformed into a convex shape and thus was inferior in peeling property of the tip and the ground electrode. The sample of test No. 2 including a tip made of a Pt-10Ni alloy was inferior in wear resistance, and the tip deformed into a concave shape. On the other hand, in each of the samples of test Nos. 8 to 10 each including a tip obtained by joining and integrating a discharge layer made of a Pt-20Rh alloy and a relieving layer made of a Pt-10Ni, Pt-20Ni, or Pt-40Ni alloy, the test results were favorable for the deformation property, the peeling property, and the wear property of the tip, so that the overall evaluation was favorable. It is found that the samples of test Nos. 8 to 10 have favorable deformation property and peeling property since each of the samples of test Nos. 8 to 10 includes a tip obtained by integrating a discharge layer that tends to deform into a convex shape and a relieving layer that tends to deform into a concave shape, and also have favorable wear resistance since a discharge layer made of a Pt-20Rh alloy having excellent wear resistance is disposed at a portion where spark discharge is caused.

When test Nos. 4 and 5 and test No. 1 are compared, whereas each sample had excellent wear resistance since, in each sample, a Pt-20Rh alloy is disposed at a portion where spark discharge is caused, each sample was inferior in deformation property and peeling property. The samples of test Nos. 4 and 5 each having a relieving layer made of Pt or a Pt-5Au alloy had a larger amount of deformation into a convex shape than the sample of test No. 1. From this, it is found that even when the tip has a relieving layer, deformation and peeling of the tip are not necessarily suppressed, and the deformation amount increases depending on the material of the relieving layer.

When test Nos. 6 and 7 and test No. 3 are compared, each sample was inferior in wear resistance at a high load since, in each sample, an alloy containing Ir is disposed at a portion where spark discharge is caused. The samples of test Nos. 6 and 7 each having a relieving layer made of a Pt-10Ni alloy had a smaller deformation amount than the sample of test No. 3 which does not have the relieving layer, and also had favorable peeling property.

When test Nos. 17 to 20 and test No. 16 are compared, the sample of test No. 16 in which the ratio A/B between the average cross-sectional area A of the discharge layer and the average cross-sectional area B of the relieving layer is greater than 1.21, had a larger deformation amount of the tip than and was inferior in deformation suppression effect to the samples of test Nos. 17 to 20 in which the ratio A/B is not less than 0.81 and not greater than 1.21.

When test Nos. 17 to 20 and test No. 21 are compared, the sample of test No. 21 in which the ratio A/B between the average cross-sectional area A of the discharge layer and the average cross-sectional area B of the relieving layer is less than 0.81, was inferior in peeling property at the joint portion between the discharge layer and the relieving layer, to the samples of test Nos. 17 to 20 in which the ratio A/B is not less than 0.81 and not greater than 1.21.

When test Nos. 11 to 13 and test Nos. 14 and 15 are compared, the samples of test Nos. 11 to 13 each including a tip having a total content of Pt and Rh of not less than 90 mass %, had favorable wear resistance at a high load as compared to the samples of test Nos. 14 and 15 each including a tip having a total content of Pt and Rh of less than 90 mass %.

When test No. 9 and test Nos. 22 and 23 are compared, the samples of test Nos. 22 and 23 in which the ratio C/D between the thickness C of the clad diffusion layer between the discharge layer and the relieving layer and the thickness D of the diffusion layer between the relieving layer and the ground electrode is equal to or less than 1, was inferior in peeling resistance at the joint portion between the discharge layer and the relieving layer, to the sample of test No. 9 in which C/D is greater than 1.

Test Nos. 24 to 26 and 27 to 29 and test Nos. 1 to 3 and 8 to 10 are different only in the shape of the tip, specifically, whereas the former includes a prism-shaped tip, the latter includes a disc-shaped tip. Meanwhile, the same evaluation results were obtained in test Nos. 24 to 26 and 1 to 3, and the same evaluation results were obtained in test Nos. 27 to 29 and 8 to 10. Therefore, it is found that the same problems occur regardless of the shape of the tip, and the same evaluation results are obtained according to the present invention.

From the above, it is found that, when a tip obtained by joining a discharge layer formed from a Pt—Rh alloy and a relieving layer formed from a Pt—Ni alloy via a clad diffusion layer is joined to a ground electrode via a diffusion layer and the ratio A/B of the average cross-sectional area A of the discharge layer and the average cross-sectional area B of the relieving layer is not less than 0.81 and not greater than 1.21, the deformation property, the peeling resistance, and the wear resistance of the tip are excellent.

DESCRIPTION OF REFERENCE NUMERALS

1: spark plug
2: axial hole
3: insulator
4: center electrode
5: metal terminal
6: connection portion
7: metallic shell
8, 308, 408, 508, 608, 708*a*, 708*b*: ground electrode
9, 309, 409, 509, 609, 709*a*, 709*b*: tip
11: rear trunk portion
12: large-diameter portion
13: front trunk portion
14: leg portion
24: screw portion
25: gas seal portion
26: tool engagement portion
27: crimping portion
28: rear end portion
29: rod-like portion
31, 631: opposed surface
40, 340, 440, 540, 640: discharge layer
50, 350, 450, 550, 650: relieving layer
60: clad diffusion layer
70: diffusion layer
41: discharge surface
632: recess
G: spark discharge gap
C: thickness of clad diffusion layer
D: thickness of diffusion layer Having described the invention, the following is claimed:

1. A spark plug comprising:
a center electrode;
a ground electrode disposed opposite to the center electrode with a gap therebetween; and
a tip joined to an opposed surface of the ground electrode that is opposed to the center electrode, wherein
the tip has a discharge layer and a relieving layer,
the relieving layer is formed from a Pt—Ni alloy and joined to the opposed surface via a diffusion layer,
the diffusion layer has a gradient composition in which a Pt content increases and/or a Ni content decreases from the ground electrode side toward the relieving layer side,
the discharge layer is formed from a Pt—Rh alloy and joined via a clad diffusion layer to a side of the relieving layer opposite to a side of the relieving layer at which the ground electrode is joined,
the clad diffusion layer has a gradient composition in which a Pt content increases and/or a Ni content decreases from the relieving layer side toward the discharge layer side,
$0.81 \leq A/B \leq 1.21$ is satisfied when an average cross-sectional area of a plurality of cross-sections of the discharge layer obtained when the discharge layer is cut along planes parallel to the opposed surface is A $mm^2$ and an average cross-sectional area of a plurality of cross-sections of the relieving layer obtained when the relieving layer is cut along planes parallel to the opposed surface is B $mm^2$, and
$C>D$ is satisfied when a thickness of the clad diffusion layer is C μm and a thickness of the diffusion layer is D μm.

2. A spark plug according to claim 1, wherein the discharge layer has a total content of Pt and Rh of not less than 90 mass %.

3. A spark plug according to claim 1, wherein the discharge layer has a total content of Pt and Rh of not less than 90 mass %.

4. A method for producing a spark plug having a center electrode;
a ground electrode disposed opposite to the center electrode with a gap therebetween; and
a tip joined to an opposed surface of the ground electrode that is opposed to the center electrode, wherein
the tip has a discharge layer and a relieving layer,
the relieving layer is formed from a Pt—Ni alloy and joined to the opposed surface via a diffusion layer,
the diffusion layer has a gradient composition in which a Pt content increases and/or a Ni content decreases from the ground electrode side toward the relieving layer side,
the discharge layer is formed from a Pt—Rh alloy and joined via a clad diffusion layer to a side of the relieving layer opposite to a side of the relieving layer at which the ground electrode is joined, the clad diffusion layer has a gradient composition in which a Pt content increases and/or a Ni content decreases from the relieving layer side toward the discharge layer side, $0.81 \leq A/B \leq 1.21$ is satisfied when an average cross-sectional area of a plurality of cross-sections of the discharge layer obtained when the discharge layer is cut along planes parallel to the opposed surface is A $mm^2$ and an average cross-sectional area of a plurality of cross-sections of the relieving layer obtained when the relieving layer is cut along planes parallel to the opposed surface is B $mm^2$, and $C>D$ is satisfied when a thickness of the clad diffusion layer is C μm and a thickness of the diffusion layer is D μm;

the method comprising:

joining the relieving layer and the opposed surface to each other by means of solid phase diffusion joining after the discharge layer and the relieving layer are joined to each other by means of solid phase diffusion joining to form the tip.

5. A method for producing a spark plug according to claim 4, wherein the discharge layer has a total content of Pt and Rh of not less than 90 mass %.

* * * * *